United States Patent [19]

Gurley

[11] 4,089,548

[45] May 16, 1978

[54] HYDRAULIC RELEASING TOOL WITH PLUG

[75] Inventor: Derrel G. Gurley, Houston, Tex.

[73] Assignee: The Dow Chemical Company, Midland, Mich.

[21] Appl. No.: 731,599

[22] Filed: Oct. 12, 1976

[51] Int. Cl.[2] ..... E21B 23/00; F16L 37/22

[52] U.S. Cl. ..... 285/3; 285/2; 166/237; 285/18; 285/315

[58] Field of Search ..... 294/83 AA, 86.1, 86.14, 294/86.15, 86.17, 86.18, 86.26; 166/123, 125, 181, 237, 239; 285/3, 18, 276, 277, 315, 1, 2, 304

[56] References Cited

U.S. PATENT DOCUMENTS

| | | | |
|---|---|---|---|
| 2,315,931 | 4/1943 | Burt et al. | 166/125 X |
| 2,409,811 | 10/1946 | Taylor et al. | 166/125 |
| 2,776,015 | 1/1957 | Bielstein | 166/181 X |
| 2,978,032 | 4/1961 | Hanna | 166/125 X |

*Primary Examiner*—Johnny D. Cherry
*Attorney, Agent, or Firm*—Merton B. Lilly; Earl D. Ayers

[57] ABSTRACT

The invention is an elongated tool for detachably connecting a sand screen and liner assembly to a tubing string. The tool comprises a releasing housing sleeve, a hookup nipple section which partly telescopes within the releasing housing sleeve with the telescoped end closed by a removable hookup nipple plug. A movable hollow piston having a ball valve seat at one end and a cross bore extending through its other end part fits within the other end of the releasing housing sleeve with the cross bore aligned with longitudinally extending slots in the releasing housing sleeve.

The hookup nipple has circumferentially extending grooves near its upper end which each mate with an array of bores extending through the releasing housing sleeve. Ball detent elements are disposed in the bores and grooves.

When a ball dropped from above seats on the piston valve seat, pressure is applied through the tubing to force the piston downwardly (after breaking a shear pin), dropping a retainer sleeve having an array of slots near its lower end to uncover the arrays of bores and permitting the ball detent elements to fall out. The releasing housing sleeve is thus disconnected from the hookup nipple with the hookup nipple in place.

9 Claims, 5 Drawing Figures

HYDRAULIC RELEASING TOOL WITH PLUG

BACKGROUND OF THE INVENTION

This invention relates to down-hole releasing tools and particularly to hydraulically actuated releasing tools in which a removable plug is provided in the lower released part of the tool.

The tool of the invention is especially suited to connecting sand screen and liner assemblies to a tubing string.

Conventional connecting tools for such use often disconnect the screen and liner assemblies on rotation of the tool, but this releasing method is not positive acting and there is no real indication at the well head when or if the disconnection occurred.

Further there is a danger that the open end of the tool part might be filled with gravel packing material during the gravel packing operation.

OBJECTS OF THE INVENTION

A principal object of this invention is to provide an improved tool for disconnecting down-hole apparatus from a tubing string.

Another object of this invention is to provide an improved hydraulically actuated tool for disconnecting down-hole apparatus from a tubing string.

A further object of this invention is to provide improved, positive acting, hydraulically actuated apparatus for disconnecting, in an earth well, a sand screen and liner assembly from a tubing string.

An additional object of this invention is to provide an improved tool for disconnecting down-hole tubular apparatus from a tubing string in which the released part has a removable plug.

STATEMENT OF INVENTION

In accordance with this invention, there is provided an elongated tool for connecting and disconnecting a sand screen and liner assembly to a tubing string. The tool comprises a releasing housing sleeve, a hookup nipple section which partly telescopes within the releasing housing sleeve with the telescoped end closed by a removable hookup nipple plug. A movable hollow piston having a ball valve seat at one end and a cross bore extending through its other end part fits within the other end of the releasing housing sleeve with the cross bore aligned with longitudinally extending slots in the releasing housing sleeve.

The hookup nipple has circumferentially extending grooves near its upper end which each mate with an array of bores extending through the releasing housing sleeve. Ball detent elements are disposed in the bores and grooves.

A retainer sleeve fits over the releasing housing sleeve, covers the arrays of bores in the releasing housing sleeve, and contains near its lower end part an array of slots which are axially aligned with the arrays of bores in the releasing housing sleeve.

A pair of bores near the upper end of the retainer sleeve are aligned with the cross bore in the piston and the previously mentioned slots in the releasing housing sleeve. Coupling means extends from the retainer sleeve to the cross bore of the piston through the slots in the releasing housing sleeve.

When a ball dropped from above seats on the piston valve seat, pressure is applied through the tubing to force the piston downwardly (after breaking a shear pin), dropping the retainer sleeve to uncover the arrays of bores and permitting the ball detent elements to fall out. The releasing housing sleeve is thus disconnected from the hookup nipple with the hookup nipple in place.

Circulation of gravel-liquid slurry is accomplished through a port in the wall of the releasing housing sleeve which was previously sealed by the piston but opened as the piston advanced beyond the port.

The hookup nipple plug later can be retrieved in a conventional manner by a fishing tool on a wire line.

BRIEF DESCRIPTION OF THE DRAWINGS

The invention, as well as additional objects and advantages thereof, will best be understood when the following detailed description is read in conjunction with the accompanying drawings, in which.

DETAILED DESCRIPTION OF THE DRAWINGS

Figure 1A:
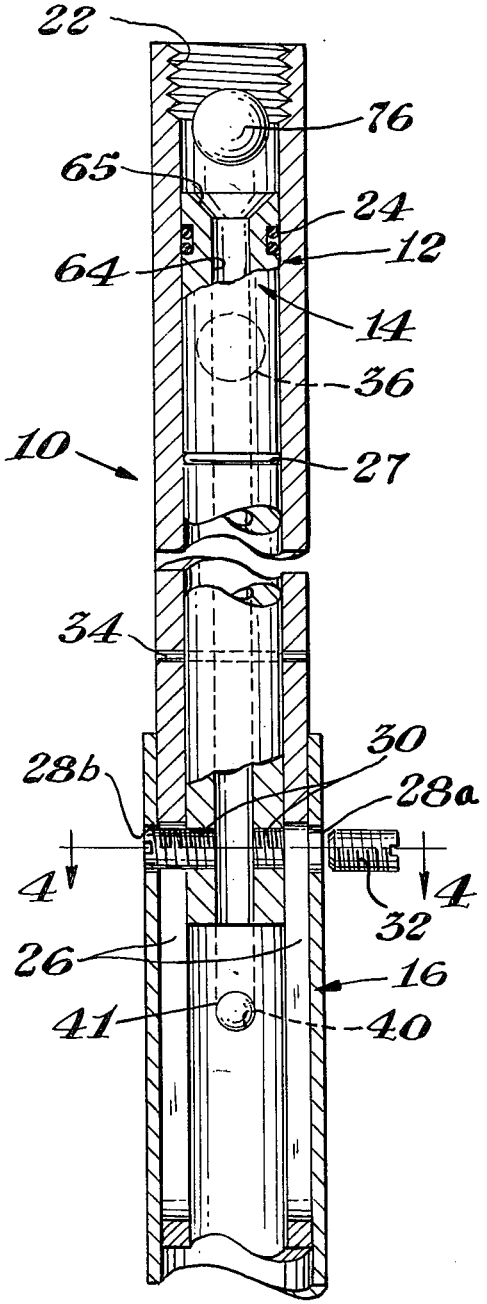
FIGS. 1*a* and 1*b* show, in elevational view, partly broken array and in section, apparatus in accordance with this invention.
Figure 1B:
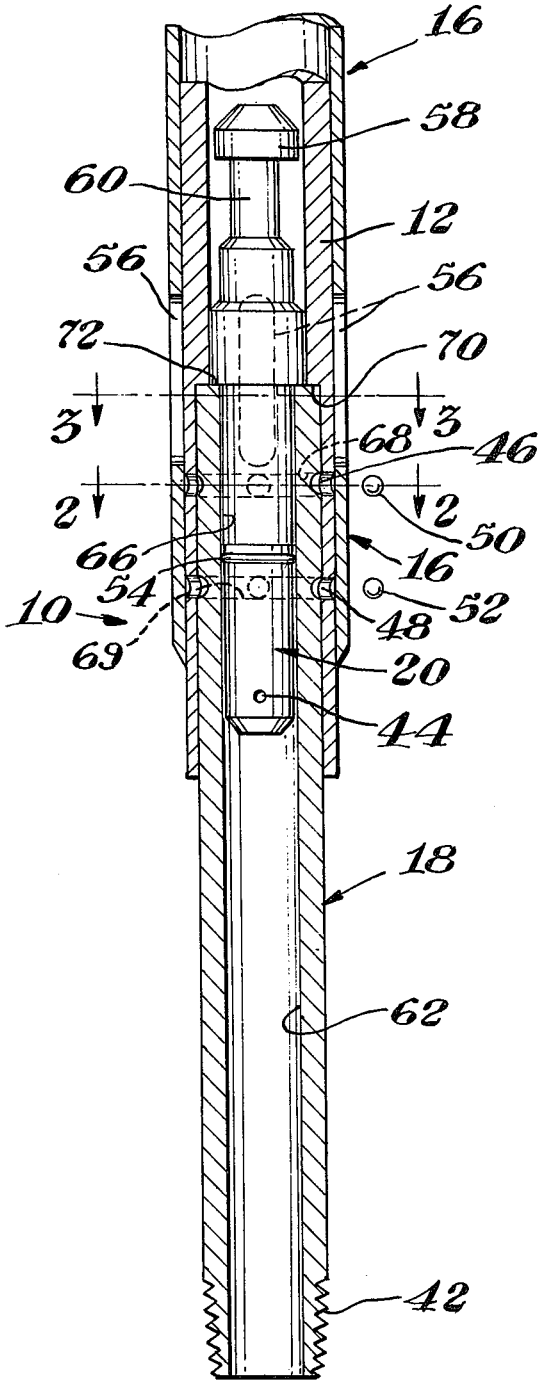
Figure 2:
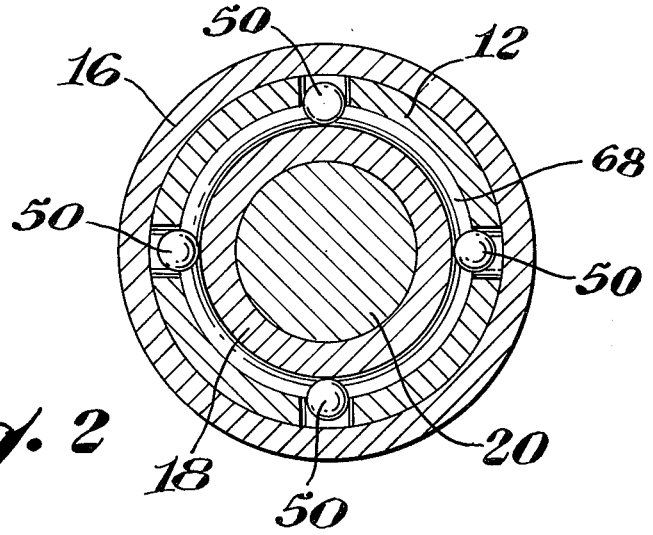
FIG. 2 is a sectional view taken along the line 2—2 of FIG. 1.
Figure 3:
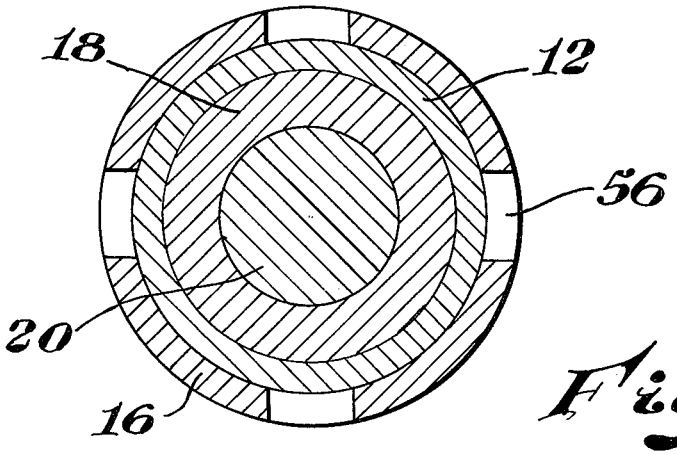
FIG. 3 is a sectional view taken along the line 3—3 of FIG. 1.
Figure 4:
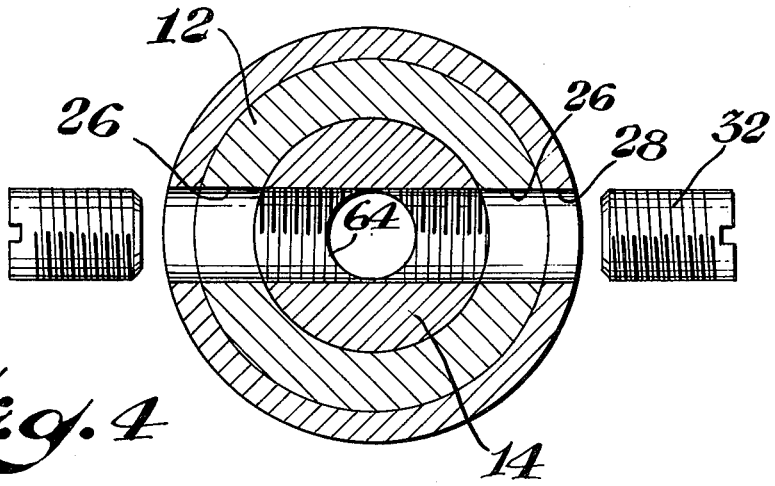
FIG. 4 is a sectional view taken along the line 4—4 of FIG. 1.

Referring to FIGS. 1 through 4, there is shown hydraulic releasing apparatus, indicated generally by the numeral 10, comprising a releasing housing sleeve 12, a movable hollow piston 14 fitting closely but slidably within the sleeve 12, a retainer sleeve 16, a hookup nipple 18, and a hookup nipple plug 20.

The upper part of the hookup nipple 18 fits slidably within and abuts against a shoulder 70 in the inner wall of the releasing housing sleeve 12.

A pair of circumferentially extending grooves 68, 69 are disposed in the outer surface of the upper end part of the hookup nipple 18. When the hookup nipple 18 is abutting against the shoulder 70, the grooves 68, 69 are aligned with the arrays of bores 46, 48 in the releasing housing sleeve 12.

The retainer sleeve 16 fits slidably over the releasing housing sleeve 12, its lower end part covering the bores 46, 48. Ball-like detent elements 50, 52 fit in the grooves 68, 69 and bores 46, 48, respectively, preventing movement between the hookup nipple 16 and the releasing housing sleeve 12.

A shear pin 44 extends between the hookup nipple 18 and the hookup nipple plug 20.

The upper end 58 of the hookup nipple plug 20 is attached to a smaller diameter section 60 of the plug 20. An "O" ring seal 54 seals the space between the hookup nipple plug 20 and the adjacent inner wall surface 62 of the hookup nipple 18.

An array of slots, 56, in alignment with but above the bores 46, 48, extend through the wall of the retainer sleeve 16.

The piston 14 has an axial bore 64 extending through its length and a ball valve seat 65 at its upper end. A cross bore 30 extends through the piston 14 near its lower end in alignment with opposed slots 26 in the wall of the releasing housing sleeve 12 and in alignment with bores 28*a*, 28*b* in the retainer sleeve 16. Lock screws 32 engage the bore 30 in the piston 14.

The releasing housing sleeve also contains a bore 36 located just below the seal 24 and above the seal 27 in the piston wall when the piston is in the position shown in FIG. 1*a*.

Another bore 41 extends through the releasing housing sleeve below the lower end of the piston 14, and in alignment with a slot 40 in the wall of the retainer sleeve 16.

A shear pin 34 extends through the wall of the releasing housing sleeve 12 and the piston 14 below the seal 27.

OPERATION

In operation, a sand screen and tubing (not shown) are attached to the threaded end 42 of the hookup nipple 18 and tubing is connected to the upper threaded end of the releasing housing sleeve 12.

The hookup nipple 18, with the hookup nipple plug 20 in place, is telescoped into the lower part of the releasing housing sleeve 12, aligning the grooves 68, 69 with the arrays of bores 46, 48. The detent element balls 50, 52 are then placed in the bores 46, 48 and the retainer sleeve moved to cover the bores 46, 48.

The retainer sleeve 16, when covering the bores 46, 48, is aligned with the bore 30 in the piston and the slots 26 in the releasing housing sleeve 12, and the lock screws are inserted and coupled to the threads in the bore 30.

The shear pins 34 and 44 prevent unwanted movement of the piston 14 and hookup nipple plug 20 with respect to the releasing housing sleeve 12.

Once the apparatus is lowered to its appropriate position in a well bore, a ball 76 is dropped or pumped down the tubing (not shown). Until the ball seats on the valve seat 65, liquid circulation through the apparatus is through the bore 64 in the piston and out through the port 41 in the releasing housing sleeve 12.

When the ball 76 seats at valve seat 65, pressure exerted on the tubing interior causes the pin 34 to shear and the piston 14 moves downwardly, carrying the retainer sleeve 16 downwardly to permit the slots 56 to uncover the bores 46, 48 before the lock screws 32 reach the bottom of the slots 26.

The ball detents fall out and the releasing housing sleeve may then be pulled upwardly away from the hookup nipple.

The bore 36 in the upper part of the releasing housing sleeve 12, opened to the tubing interior when the piston 14 moved downwardly, permits circulation of pumpable materials through the tubing into the annulus adjacent to the tubing to which the apparatus 10 is coupled even though the releasing housing sleeve is not withdrawn from the hookup nipple 18.

The pin 44 often is unneeded and may be eliminated. However, insertion of the pin 44 prevents the blowing out of the hookup nipple plug 20 from the hookup nipple because of a pressure surge below the plug 20.

After the gravel packing is completed and the upper tubing removed, a fishing tool and jars on a wire line may be lowered into the well to engage and couple to the head 58 of the hookup nipple plug 20 and, with jarring action, shear the pin 44 (if one is used) and withdraw the hookup plug 20 from the hookup nipple 18.

What is claimed is:

1. An elongated tool for detachably connecting a sand screen and liner assembly to a tubing string, comprising a releasing housing sleeve having an upper and lower end, a hollow hookup nipple which partly telescopes within the lower end of the releasing housing sleeve, a movable hollow piston having a ball valve seat at one end and a cross bore extending through its other end part, said piston fitting within the upper end part of said releasing housing sleeve with the cross bore aligned with an array of longitudinally extending slots which are disposed in and extend through the releasing housing sleeve, said hookup nipple having circumferentially extending grooves near its upper end which each mate with an array of bores extending through the releasing housing sleeve near the lower end of said sleeve, a plurality of detent elements disposed in said array of bores and in said grooves, and a retainer sleeve, said retainer sleeve fitting over said releasing housing sleeve and being coupled to the cross bore of said piston through said array of slots to cover the arrays of bores in the releasing housing sleeve, said retainer sleeve containing near its lower end part above the part which covers said arrays of bores an array of elongated slots which are axially aligned with said arrays of bores in said releasing housing sleeve whereby downward movement of said piston forces said retainer sleeve downward, so said array of elongated slots in said retainer sleeve uncover said arrays of bores, permitting said detent elements to fall out and release said hookup nipple from said releasing housing sleeve.

2. A tool in accordance with claim 1, wherein the part of said hookup nipple disposed in said releasing housing sleeve has a removable plug element therein.

3. A tool in accordance with claim 2, wherein shear means is disposed between said hookup nipple and said plug element.

4. A tool in accordance with claim 1, wherein shear means is disposed between said piston and said releasing housing sleeve.

5. A tool in accordance with claim 1, wherein a bore extends through said releasing housing sleeve communicating with said piston when said piston is in its unadvanced position in said releasing housing sleeve.

6. A tool in accordance with claim 1, wherein said detent elements are ball like elements.

7. A tool in accordance with claim 1, wherein said valve seat is adapted to accept a ball valve element.

8. A tool in accordance with claim 1, wherein said array of longitudinally extending slots limit the upper and lower movement of said piston and said retainer sleeve.

9. A tool in accordance with claim 1, wherein pressure equalizing means is provided between the exterior and interior of said releasing housing sleeve as said piston is pushed downwardly because pressure is exerted above said valve seat while said seat is closed.

* * * * *